US006311877B1

(12) United States Patent
Yang

(10) Patent No.: US 6,311,877 B1
(45) Date of Patent: Nov. 6, 2001

(54) CONTAINER STRUCTURE CONTAINING WATER, BEVERAGE OR THE LIKE THEREIN

(76) Inventor: Min-Te Yang, No. 31, Cheng-Kuang Road, Chung-Hsai Li, Cheng-Kung Chen, Tai Tung Hsien (TW)

( * ) Notice: Subject to any disclaimer, the term of this patent is extended or adjusted under 35 U.S.C. 154(b) by 0 days.

(21) Appl. No.: 09/573,669

(22) Filed: May 19, 2000

(51) Int. Cl.[7] ..... B67D 3/00

(52) U.S. Cl. ..... 222/510; 222/481.5; 222/484; 222/530; 222/538

(58) Field of Search ..... 222/481.5, 482, 222/484, 510, 530, 538; 137/347, 587; 251/264, 273, 284, 318, 333

(56) References Cited

U.S. PATENT DOCUMENTS

| | | | | |
|---|---|---|---|---|
| 1,558,597 | * | 10/1925 | Eckard | 222/510 |
| 1,579,390 | * | 4/1926 | Peaden | 222/510 |
| 4,129,232 | * | 12/1978 | Coupar | 222/510 |
| 4,416,396 | * | 11/1983 | Ward | 222/510 |
| 5,014,883 | * | 5/1991 | Airaksinen | 222/510 |
| 6,045,013 | * | 4/2000 | Yang | 222/510 |

FOREIGN PATENT DOCUMENTS

| | | | | |
|---|---|---|---|---|
| 2658164 | * | 8/1991 | (FR) | 222/510 |

* cited by examiner

*Primary Examiner*—J. Casimer Jacyna

(57) ABSTRACT

A container structure includes a container body, a control device, a switch device, and a flexible drive member. The control device includes a lug connecting to the inside of the container body, and a rotary cap movably mounted on the lug. The switch device includes a spout located opposite to the lug and connecting to the inside of the container body, a nozzle connecting to the spout and having an inner wall provided with a tapered surface, a control valve movably mounted in the nozzle and detachably pressing the tapered surface of the nozzle, and a biasing member pressing between the control valve and the spout. The flexible drive member has a first end secured to the rotary cap to move therewith, and a second end secured to the control valve for moving it. In such a manner, the control valve is movable between a first position where the control valve presses the tapered surface of the nozzle to close the nozzle, and a second position where the control valve is detached from the tapered surface of the nozzle to open the nozzle so that the inside of the container body connects to the ambient environment.

10 Claims, 8 Drawing Sheets

CONTAINER STRUCTURE CONTAINING WATER, BEVERAGE OR THE LIKE THEREIN

BACKGROUND OF THE INVENTION

1. Field of the Invention

The present invention relates to a container structure, and more particularly to a container structure containing water, beverage or the like therein.

2. Description of the Related Art

A conventional container 90 in accordance with the prior art shown in FIG. 8 is used for containing a liquid such as water, beverage or the like therein. However, the user has to decline the container 90 for pouring out the liquid contained in the container 90, thereby causing inconvenience is use. In addition, the liquid easily sprays outward from the spout 92 of the container 90 when it is inclined.

The closest prior art of which the applicant is aware is disclosed in his own U.S. Pat. No. 6,045,013, filed on Oct. 7, 1998, entitled by "CONTAINER CONTAINING LIQUID OR THE LIKE THEREIN".

SUMMARY OF THE INVENTION

In accordance with one aspect of the present invention, there is provided a container structure comprising a hollow container body having a first side and a second side opposite to the first side; a control device mounted on the first side of the container body and including a lug extending outward from the first side of the container body and connecting to an inside of the container body, and a rotary cap movably mounted on the lug; a switch device mounted on the second side of the container body and including a spout extending outward from the second side of the container body and connecting to the inside of the container body, a nozzle secured on and connecting to the spout and having an inner wall provided with a tapered surface, a control valve movably mounted in the nozzle and detachably pressing the tapered surface of the nozzle, and a biasing member received in the nozzle and having a first portion pressing a bottom portion of the control valve and a second portion pressing a top portion of the spout; and an elongated flexible drive member movably received in the container body and having a first end secured to the rotary cap to move therewith, and a second end secured to the control valve for moving the control valve.

By such an arrangement, the control valve is movable in the nozzle between a first position where the control valve abuts and presses the tapered surface of the nozzle so as to close the nozzle, thereby closing a connection between the inside of the container body and an ambient environment, and a second position where the control valve is detached from the tapered surface of the nozzle so as to open the nozzle so that the inside of the container body connects to the ambient environment.

Preferably, the control valve has an outer periphery provided with a tapered surface mating with the tapered surface of the nozzle.

Preferably, the spout of the switch device has an outer periphery provided with a plurality of teeth, and the inner wall of the nozzle is provided with a plurality of bosses each engaged with each of the teeth of the spout, thereby preventing the nozzle from detaching from the spout.

Further benefits and advantages of the present invention will become apparent after a careful reading of the detailed description with appropriate reference to the accompanying drawings.

DETAILED DESCRIPTION OF THE INVENTION

Figure 1:
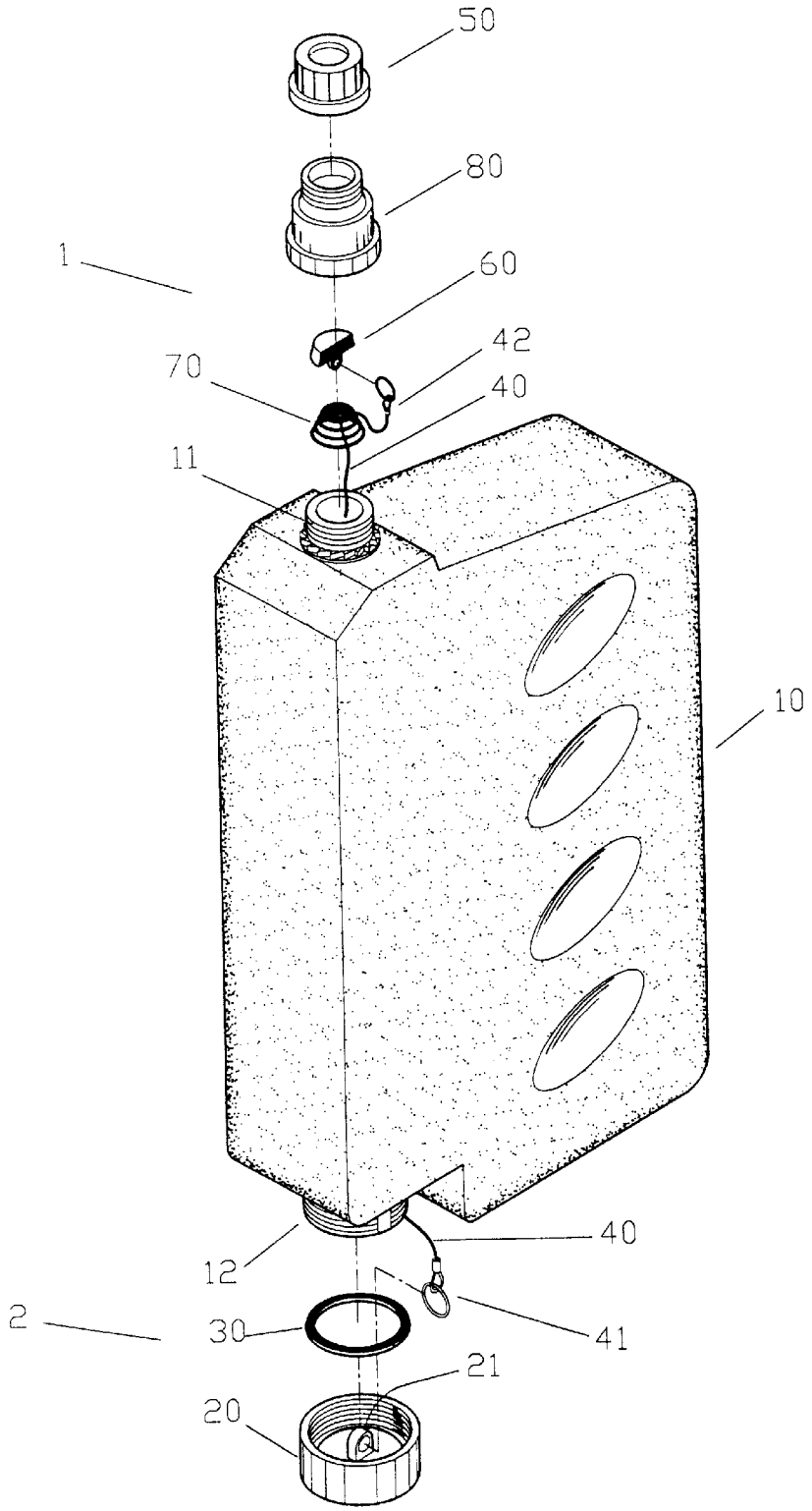
FIG. 1 is an exploded view of a container structure in accordance with the present invention.

Referring to the drawings and initially to FIGS. 1–4, a container structure in accordance with the present invention is used for filling and containing a liquid such as water, beverage or the like therein, and comprises a hollow container body 10 having a first side and a second side opposite to the first side, a switch device 1, a control device 2 located opposite to the switch device 1, and an elongated flexible drive member 40.

The control device 2 is mounted on the first side of the container body 10 and includes a lug 12 extending outward from the first side of the container body 10 and connecting to the inside of the container body 10, a concave rotary cap 20 movably mounted or screwed on the lug 12, and a sealing ring 30 mounted between the lug 12 and the rotary cap 20 for providing a sealing effect to prevent leakage of the liquid contained in the container body 10. The lug 12 has an outer wall provided with an outer thread 121, and the rotary cap 20 has an inner wall provided with an inner thread 22 screwed on the outer thread 121 of the lug 12. The outer thread 121 of the lug 12 defines an air passage depression 123 therein.

The switch device 1 is mounted on the second side of the container body 10 and includes a spout 11 extending outward from the second side of the container body 10 and connecting to the inside of the container body 10, a hollow nozzle 80 secured or screwed on and connecting to the spout 11 and having an inner wall provided with a tapered surface 83, a control valve 60 movably mounted in the nozzle 80 and detachably pressing the tapered surface 83 of the nozzle 80, and a biasing member 70, such as a spring, received in the nozzle 80 and having a first portion pressing the bottom portion of the control valve 60 and a second portion pressing the top portion of the spout 11. The control valve 60 has an outer periphery provided with a tapered surface 62 mating with the tapered surface 83 of the nozzle 80.

The spout 11 of the switch device 1 has an outer periphery provided with a plurality of teeth 111, and the inner wall of the nozzle 80 is provided with a plurality of bosses 82 each engaged with each of the teeth 111 of the spout 11, thereby preventing the nozzle 80 from detaching from the spout 11.

The nozzle 80 has an outer wall provided with an outer thread 81, and the switch device 1 further includes an end cap 50 detachably screwed on the outer thread 81 of the nozzle 80, thereby preventing dirt, dust or the like from entering the nozzle 80.

The elongated flexible drive member 40 is movably received in the container body 10 and has a first end 41 secured to the rotary cap 20 to move therewith, and a second end 42 secured to the control valve 60 for moving the control valve 60. The rotary cap 20 is provided with a fastening ear 21, and the first end 41 of the flexible drive member 40 is secured to the fastening ear 21 of the rotary cap 20.

By such an arrangement, the control valve 60 is movable in the nozzle 80 between a first position where the control valve 60 abuts and presses the tapered surface 83 of the nozzle 80 so as to close the nozzle 80, thereby interrupting and closing a connection between the inside of the container body 10 and an ambient environment, and a second position where the control valve 60 is detached from the tapered surface 83 of the nozzle 80 so as to open the nozzle 80 so that the inside of the container body 10 connects to the ambient environment.

Figure 2:
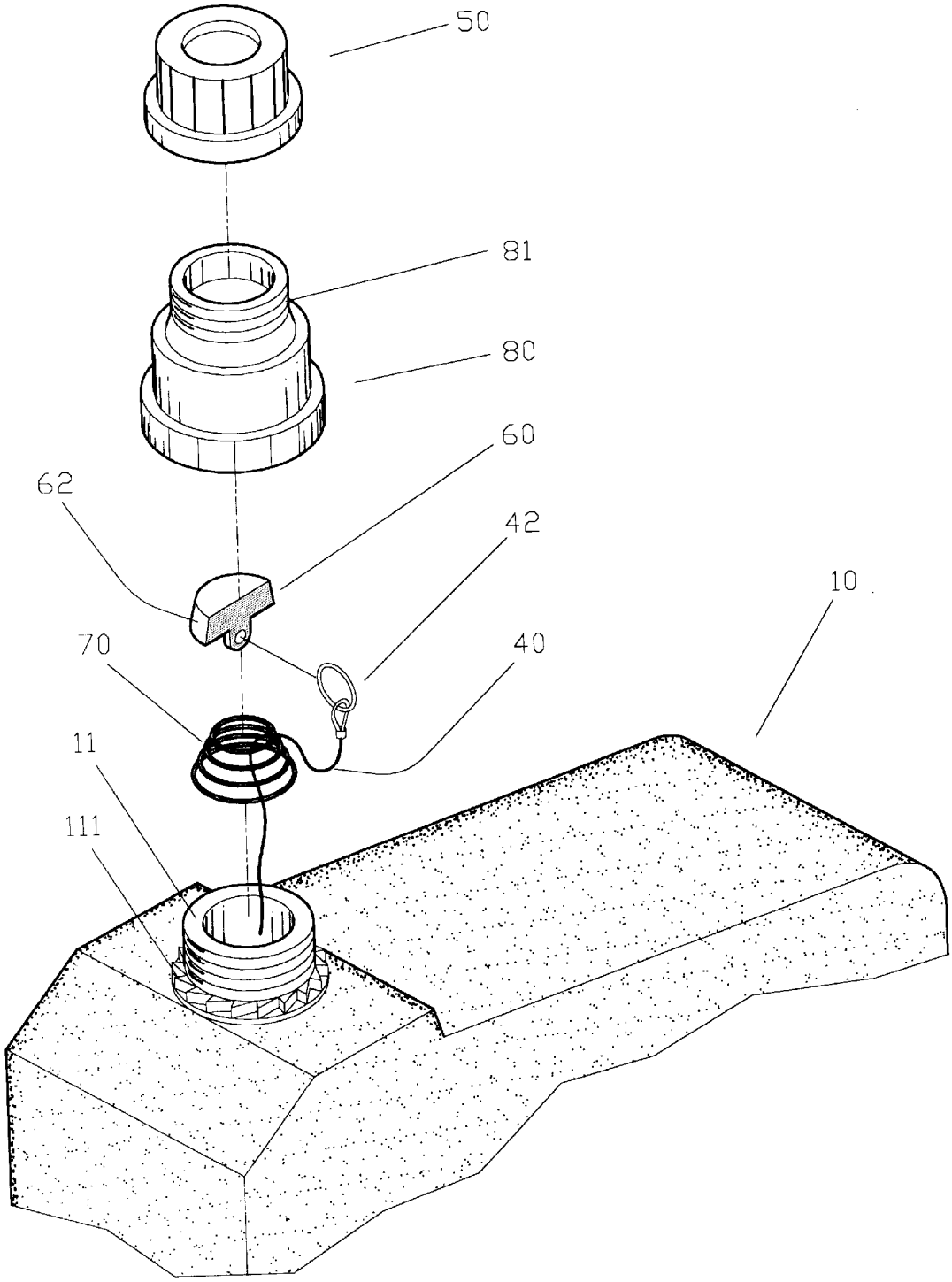
FIG. 2 is a partially enlarged view of the container structure as shown in FIG. 1.
Figure 3:
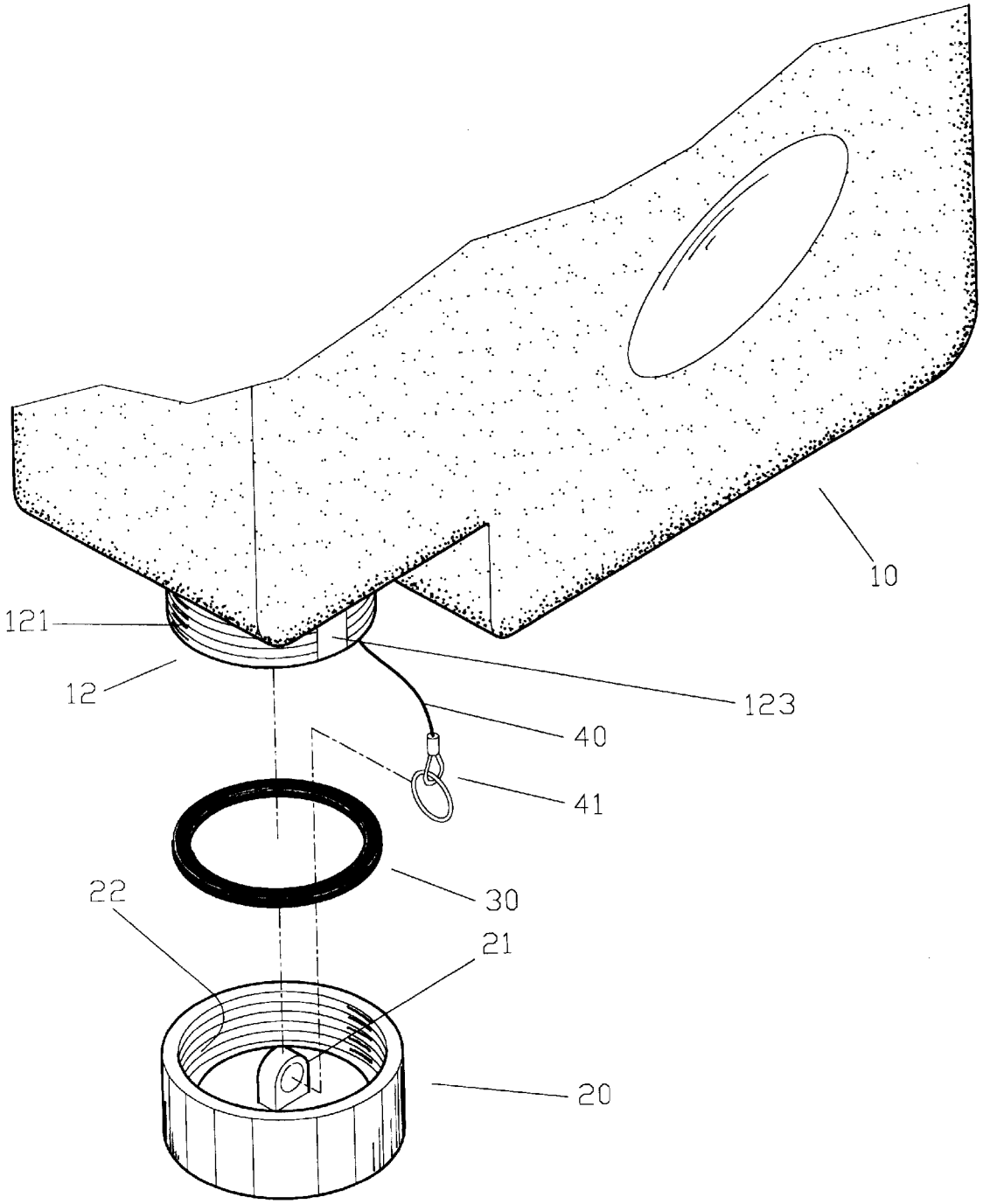
FIG. 3 is a partially enlarged view of the container structure as shown in FIG. 1.
Figure 4:
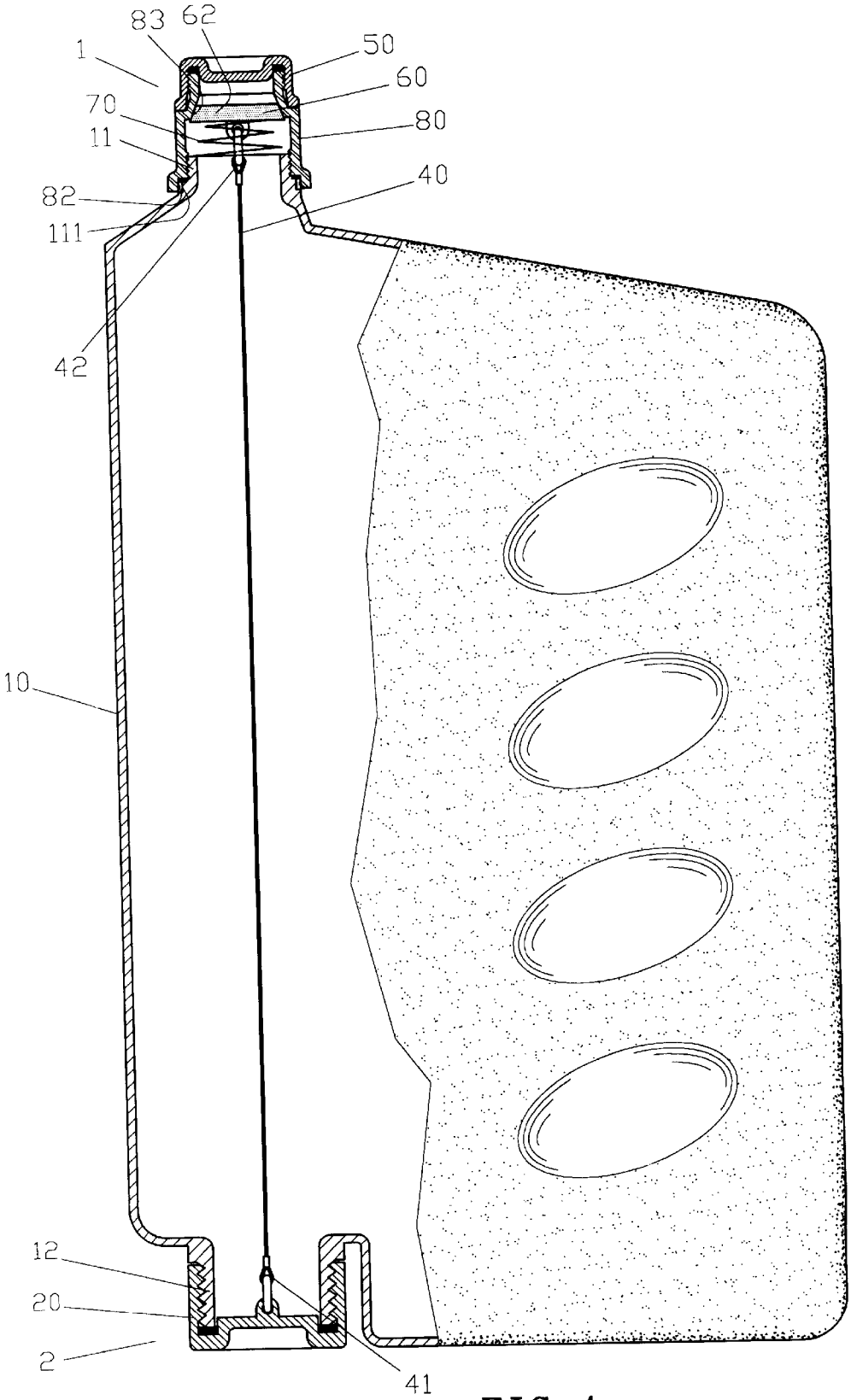
FIG. 4 is a front plan cross-sectional assembly view of the container structure as shown in FIG. 1.
Figure 5:
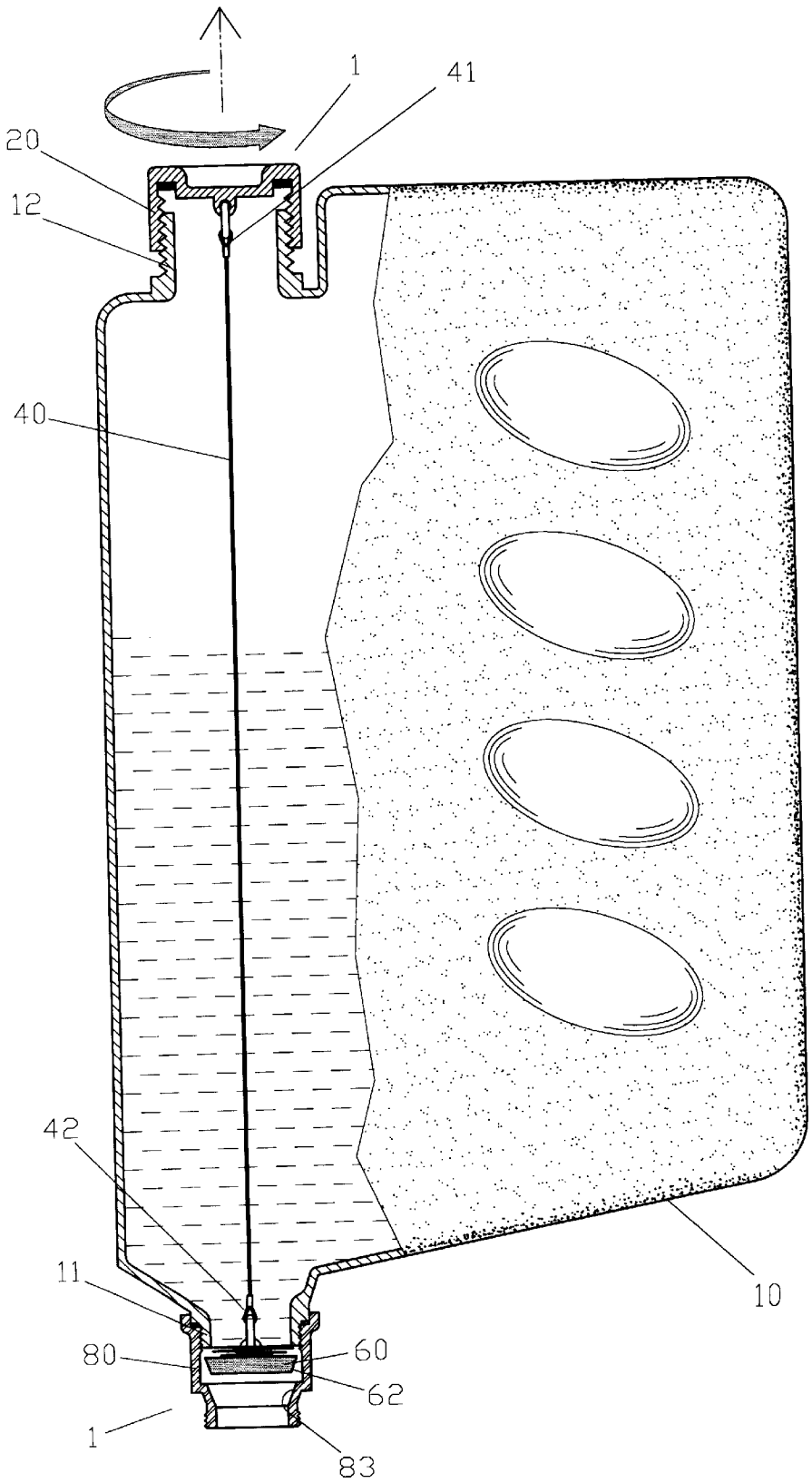
FIG. 5 is an operational view of the container structure as shown in FIG. 4.
Figure 6:
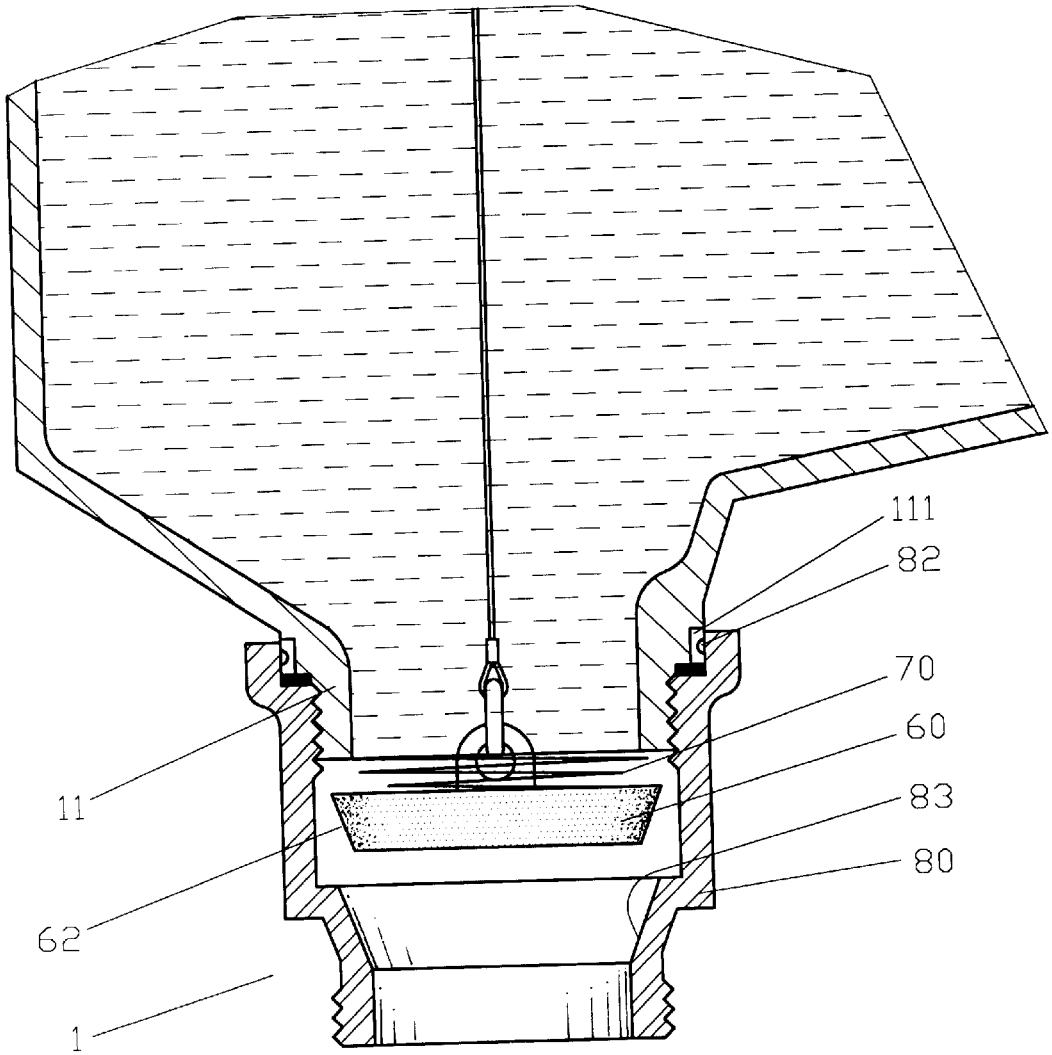
FIG. 6 is a partially enlarged view of the container structure as shown in FIG. 5.

In operation, referring to FIGS. 4–6 with reference to FIGS. 1–3, the control valve 60 is initially pressed upward by the biasing member 70 so that the tapered surface 62 of the control valve 60 is tightly engaged with the tapered surface 83 of the nozzle 80 as shown in FIG. 4, thereby closing the nozzle 80 without connecting to the ambient environment.

When the user wishes to pour out the liquid contained in the container body 10, the end cap 50 is initially removed from the nozzle 80. The container body 10 can then be inverted from the position as shown in FIG. 4 to the position as shown in FIG. 5 so that the nozzle 80 is directed downward. The rotary cap 20 is then rotated relative to the lug 12 to move the first end 41 of the drive member 40 upward, thereby moving the control valve 60 upward by the second end 42 of the drive member 40 so that the tapered surface 62 of the control valve 60 is detached from the tapered surface 83 of the nozzle 80 as shown in FIGS. 5 and 6 to open the nozzle 80, thereby connecting the inside of the container body 10 to the ambient environment so that the liquid contained in the container body 10 can flow downward through the spout 11 and the nozzle 80.

The air passage depression 123 longitudinally defined in the outer thread 121 of the lug 12 will allow air entering the inside of the container body 10 so that the liquid can flow outward conveniently without a possibility of incurring an intermittent flow. In addition, the rotary cap 20 can be used to control the flow rate of the liquid without having to decline the container body 10 or change the inclined angle of the container body 10 for controlling the flow rate of the liquid.

Figure 7:
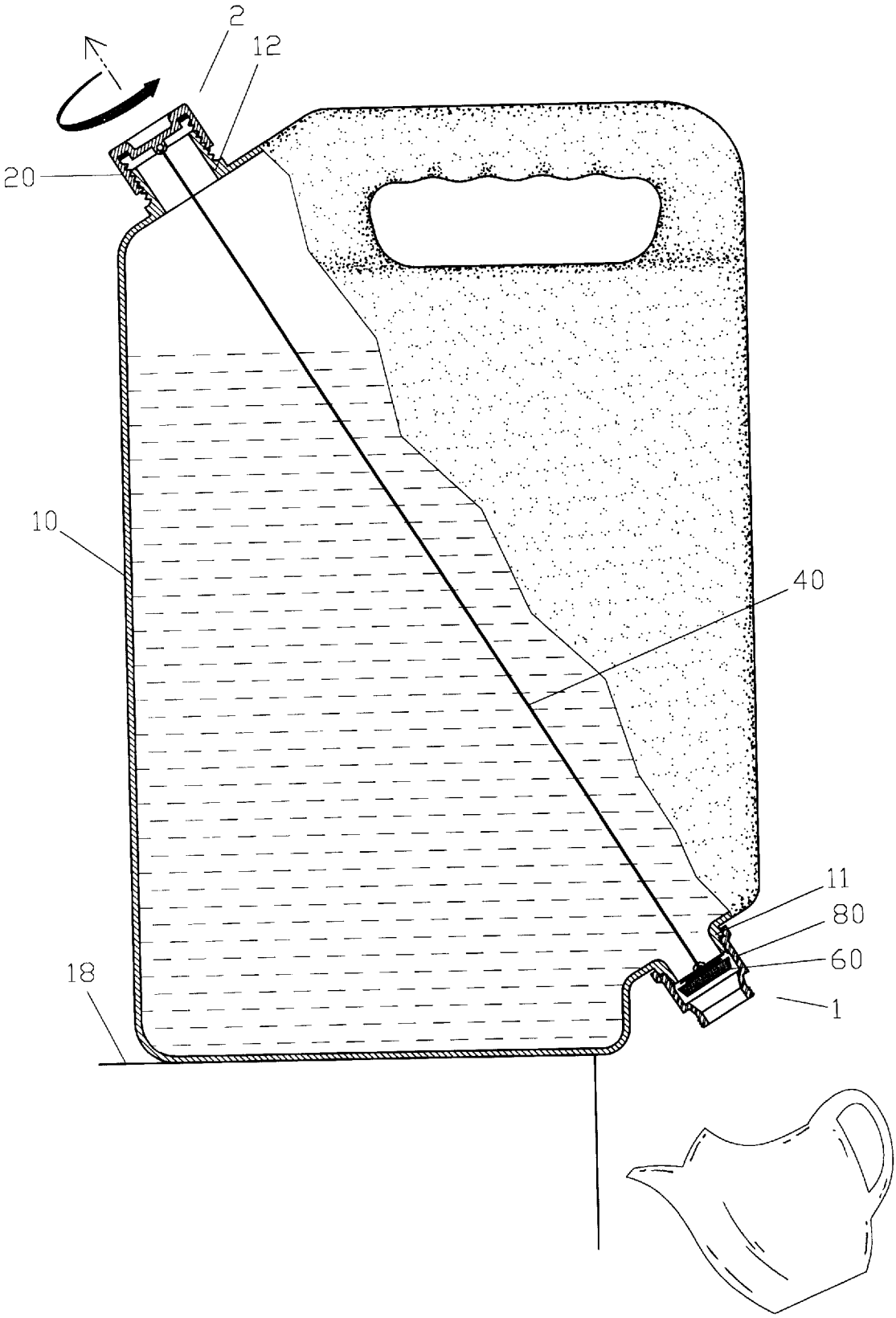
FIG. 7 is a front plan cross-sectional assembly view of the container structure in accordance with another embodiment of the present invention.
Figure 8:
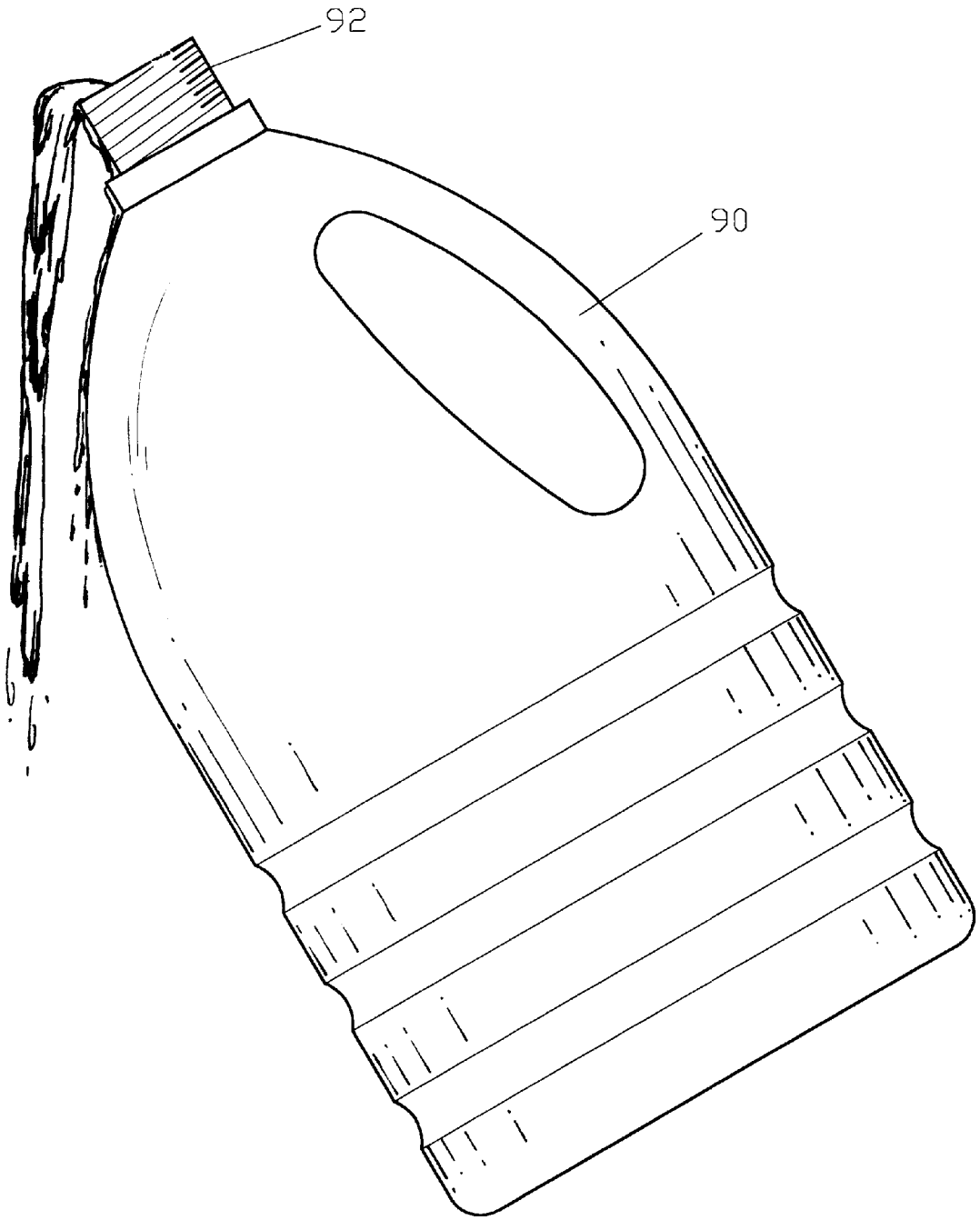
FIG. 8 PRIOR ART
FIG. 8 is a front plan view of a conventional container in accordance with the prior art.

Referring to FIG. 7, in accordance with another embodiment of the present invention, the spout 11 together with the nozzle 80 of the switch device 1 is located diagonally opposite to the lug 12 together with the rotary cap 20 of the control device 2 so that the container body 10 can be supported on a table 18, thereby facilitating the liquid contained in the container body 10 flowing outward and pouring out, and thereby saving manual work.

Accordingly, the container structure in accordance with the present invention has the following advantages.

First, the control valve 60 is moved to open the nozzle 80 by means of rotating the rotary cap 20 to pour out the liquid contained in the container body 10. In such a manner, the user needs not to take up and decline the container body 10 for pouring out the liquid contained in the container body 10, thereby saving energy.

Secondly, the rotary cap 20 can be used to control the flow rate of the liquid without having to decline the container body 10 for controlling the flow rate, thereby preventing the liquid from spraying outward due to inclination of the container body 10.

Third, the container structure is easily assembled and dismantled, thereby facilitating the user erecting the container structure.

Fourth, the container structure includes a simple construction with few parts, thereby greatly decreasing the cost of fabrication.

It should be clear to those skilled in the art that further embodiments may be made without departing from the scope of the present invention.

What is claimed is:

1. A container structure comprising:

a hollow container body (10) having a first side and a second side opposite to said first side;

a control device (2) mounted on said first side of said container body (10) and including a lug (12) extending outward from said first side of said container body (10) and connecting to an inside of said container body (10), and a rotary cap (20) movably mounted on said lug (12);

a switch device (1) mounted on said second side of said container body (10) and including a spout (11) extending outward from said second side of said container body (10) and connecting to the inside of said container body (10), a nozzle (80) secured on and connecting to said spout (11) and having an inner wall provided with a tapered surface (83), a control valve (60) movably mounted in said nozzle (80) and detachably pressing said tapered surface (83) of said nozzle (80), and a biasing member (70) received in said nozzle (80) and having a first portion pressing a bottom portion of said control valve (60) and a second portion pressing a top portion of said spout (11); and an elongated flexible drive member (40) movably received in said container body (10) and having a first end (41) secured to said rotary cap (20) to move therewith, and a second end (42) secured to said control valve (60) for moving said control valve (60);

wherein, said control valve (60) is movable in said nozzle (80) between a first position where said control valve (60) abuts and presses said tapered surface (83) of said nozzle (80) so as to close said nozzle (80), thereby closing a connection between the inside of said container body (10) and an ambient environment, and a second position where said control valve (60) is detached from said tapered surface (83) of said nozzle (80) so as to open said nozzle (80) so that the inside of said container body (10) connects to the ambient environment.

2. The container structure in accordance with claim 1, wherein said control valve (60) has an outer periphery provided with a tapered surface (62) mating with said tapered surface (83) of said nozzle (80).

3. The container structure in accordance with claim 1, wherein said spout (11) of said switch device (1) has an outer periphery provided with a plurality of teeth (111).

4. The container structure in accordance with claim 3, wherein said inner wall of said nozzle (80) is provided with a plurality of bosses (82) each engaged with each of said teeth (111) of said spout (11), thereby preventing said nozzle (80) from detaching from said spout (11).

5. The container structure in accordance with claim 1, wherein said nozzle (80) has an outer wall provided with an outer thread (81), and said switch device (1) further includes an end cap (50) detachably screwed on said outer thread (81) of said nozzle (80).

6. The container structure in accordance with claim 1, wherein said rotary cap (20) is provided with a fastening ear (21), and said first end (41) of said flexible drive member (40) is secured to said fastening ear (21) of said rotary cap (20).

7. The container structure in accordance with claim 1, wherein said control device (2) further includes a sealing ring (30) mounted between said lug (12) and said rotary cap (20).

8. The container structure in accordance with claim 1, wherein said lug (12) has an outer wall provided with an outer thread (121), and said rotary cap (20) has an inner wall provided with an inner thread (22) screwed on said outer thread (121) of said lug (12).

9. The container structure in accordance with claim 8, wherein said outer thread (121) of said lug (12) defines an air passage depression (123) therein.

10. The container structure in accordance with claim 1, wherein said spout (11) of said switch device (1) is located diagonally opposite to said lug (12) of said control device (2).

* * * * *